United States Patent [19]

White et al.

[11] 4,275,383

[45] Jun. 23, 1981

[54] PATIENT SIGNALLING SYSTEM

[76] Inventors: Roland A. White; Mark D. White, both of 10 Terry St., Middleport, N.Y. 14105

[21] Appl. No.: 79,783

[22] Filed: Sep. 28, 1979

[51] Int. Cl.[3] ..... G08B 1/08

[52] U.S. Cl. ..... 340/286 R; 340/365 C

[58] Field of Search ..... 340/286 R, 365 C, 636

[56] References Cited

U.S. PATENT DOCUMENTS

| | | | |
|---|---|---|---|
| 3,517,120 | 6/1970 | Bunting | 340/286 |
| 3,581,124 | 5/1971 | Flores | 340/365 C |
| 3,740,744 | 6/1973 | Nakada | 340/365 C |
| 3,766,404 | 10/1973 | Larson | 340/365 C X |
| 3,848,249 | 11/1974 | Meiri | 340/286 R |
| 3,857,100 | 12/1974 | Baars | 340/365 C |
| 3,877,001 | 4/1975 | Bogut | 340/636 X |
| 3,947,696 | 3/1976 | Larson | 340/365 C |
| 4,126,874 | 11/1978 | Suzuki | 340/636 X |

*Primary Examiner*—Harold I. Pitts

*Attorney, Agent, or Firm*—Christel, Bean & Linihan

[57] ABSTRACT

A patient signalling system comprising a touch sensitive capacitive transducer adapted to be conveniently and comfortably placed with a patient afflicted with an illness or paralysis rendering him incapable of producing any significant manual force or dexterity, a flexible electrical cable of appreciable length connected at one end to the transducer, and a circuit located remote from the patient and connected to the other end of the cable for converting a change in capacitance of the transducer when touched by the patient into an electrical signal for causing operation of an appliance such as a signalling or communication device connected to the circuit. The circuit includes an input stage in the form of a high input impedance semiconductor device, a direct coupled a.c. amplifier, a resistive coupled a.c. amplifier, and a d.c. semiconductor switch. The system can include provision for patient electrical isolation and low battery voltage indication.

17 Claims, 4 Drawing Figures

PATIENT SIGNALLING SYSTEM

BACKGROUND OF THE INVENTION

This invention relates to the art of medical electronics, and more particularly to a new and improved patient signalling system.

One area of use of the present invention is in enabling patients to sound an alarm or call for help, although the principles of the present invention can be variously applied. Patients suffering from multiple sclerosis, amyotrophic sclerosis, similar neurological disorders and strokes often are afflicted with loss of speech and limited capability of movement, and usually such patients are unable to push buttons or manipulate conventional switches on existing patient alarm and calling systems. Accordingly, it would be highly desirable to provide a patient alarm or calling system which is activated in a manner requiring the slightest expenditure of effort on the part of the patient.

In providing such a patient-activated alarm or calling system a number of requirements must be considered. There must be electrical compatibility between the system and electrically-operated relays, solid state relays or optical isolators and the like at the inputs of intercom devices or other appliances which the system is to signal or cause operation thereof. Also, typically such intercom devices and other appliances are a.c. operated, and it would be highly desirable to eliminate the possibility of any shock hazard to the patient so that the system can be utilized also in intensive care and cardiac care environments.

SUMMARY OF THE INVENTION

It is, therefore, a primary object of this invention to provide a new and improved patient signalling system.

It is a further object of this invention to provide such a system which is touch responsive.

It is a further object of this invention to provide such a system which is both touch responsive and capable of operating electromagnetic relays, solid state relays and optical isolators and the like commonly found in intercom and other alarm devices.

It is a further object of this invention to provide such a system which is touch responsive, electrically compatible with a.c.-operated alarm or communication devices, and free of any electrical shock hazards to the patient.

It is a further object of this invention to provide such a system which is simple and economical in construction and effective and reliable in operation.

The present invention provides a patient signalling system comprising a touch sensitive capacitive transducer adapted to be conveniently and comfortably placed with a patient afflicted with an illness or paralysis rendering him incapable of producing any significant manual force or dexterity, a flexible electrical cable of appreciable length connected at one end to the transducer, and a circuit located remote from the patient and connected to the other end of the cable for converting a change in capacitance of the transducer when touched by the patient into an electrical signal for causing operation of an appliance such as a signalling or communication device connected to the circuit. The circuit includes an input stage in the form of a high input impedance semiconductor device, a direct coupled a.c. amplifier, a resistive coupled a.c. amplifier and a d.c. semiconductor switch. The system can further include means for isolating the patient electrically from the circuit ground to prevent any electrical hazard arising from the a.c. operation of the afore-mentioned appliance and a circuit for indicating when the system battery voltage level is below a predetermined value.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENTS

Figure 1:
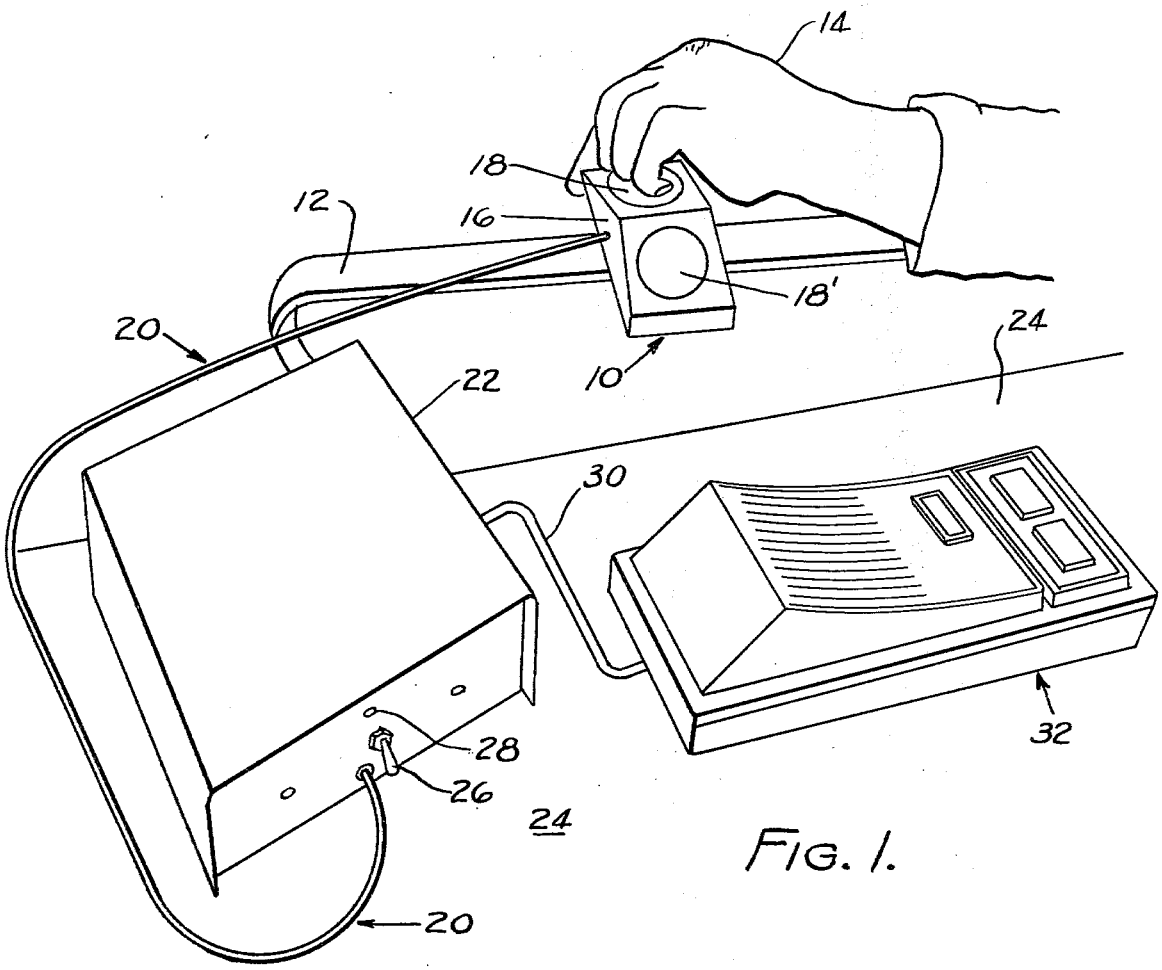
FIG. 1 is a fragmentary perspective view of a patient signalling system according to the present invention as it would appear in use.

FIG. 1 shows a patient signalling system according to the present invention as it would appear in use. The system includes a touch sensitive capacitive transducer generally designated 10 which is adapted to be conveniently and comfortably placed with a patient afflicted with an ailment or paralysis rendering him incapable of providing any useful degree of manual force or dexterity. In the present illustration the transducer 10 is supported on an arm rest 12 of a bed or chair so as to be within convenient reach of the hand 14 of the patient. The transducer can of course be located at any other convenient and readily accessible location which is comfortable for the patient. In preferred form the transducer comprises a body 16 of dielectric material and a conductive plate 18 carried by the body. Body 16 typically can be rectangular solid in shape with the conductive plate embedded or otherwise affixed in one surface of the body so as to be exposed for touching contact by the finger or other extremity of the patient. For example, plate 18 can be fixed to body 16 by a suitable epoxy cement. In the present illustration the body 16 includes two generally inclined surfaces each bearing a conductive plate 18 and 18', the two conductive plates facilitating easy operation by the patient. Body 16 typically is a block of acrylic plastic material and plate 18 is in the form of a stainless steel disc. By virtue of this arrangement the disc 18 is electrically isolated from earth ground.

The patient signalling system further comprises a flexible electrical cable generally designated 20 of significant length which is electrically connected at one end to the plate 18 of transducer 10. Cable 20 is of conventional insulated variety suitable for transmitting the electrical signals present in the system. The patient signalling system further comprises a circuit located remote from the patient having an input and an output, the input being connected to the other end of cable 20. In the present illustration the circuit is contained within a housing 22 which is placed on a table 24 or similar supporting surface which can be at any distance, typically a significant distance, from the patient. A manually-operated, on-off switch 26 extends from one wall of housing 22, and on this same wall an indicator lamp 28 is positioned.

The circuit within housing 22 functions to convert a changing capacitance of the transducer 10 when touched by the hand or other extremity of patient into an electrical signal for controlling an appliance connected to the output of the circuit. In the present illustration, the output of the circuit in housing 22 is connected by a cable 30 to an appliance 32 in the form of a unit forming a portion of a telephone answering apparatus. The appliance 32 shown in FIG. 1 is illustrative of known devices which would enable the patient in response to touching the transducer 10 to answer and hang up a telephone. Another typical form of the appliance 32 is an alarm or signalling unit, typically placed in another room remote from the patient, whereby the patient upon touching the transducer 10 could signal a member of the family or a nurse in another room when help or attention is needed. In that situation the appliance 32 could be one of a pair of f.m. wireless intercom units, the other of which would be placed in an another room or otherwise remote location from a patient. The f.m. wireless intercom system is locked in the talk position so that the patient can be monitored at all times. In response to the slightest touch of the patient's hand 14 on the plate 18 of transducer 10, the intercom unit is activated and sends out an audible signal alerting the person caring for the patient. Other applications and uses are possible, some of which will be mentioned presently.

Figure 2:
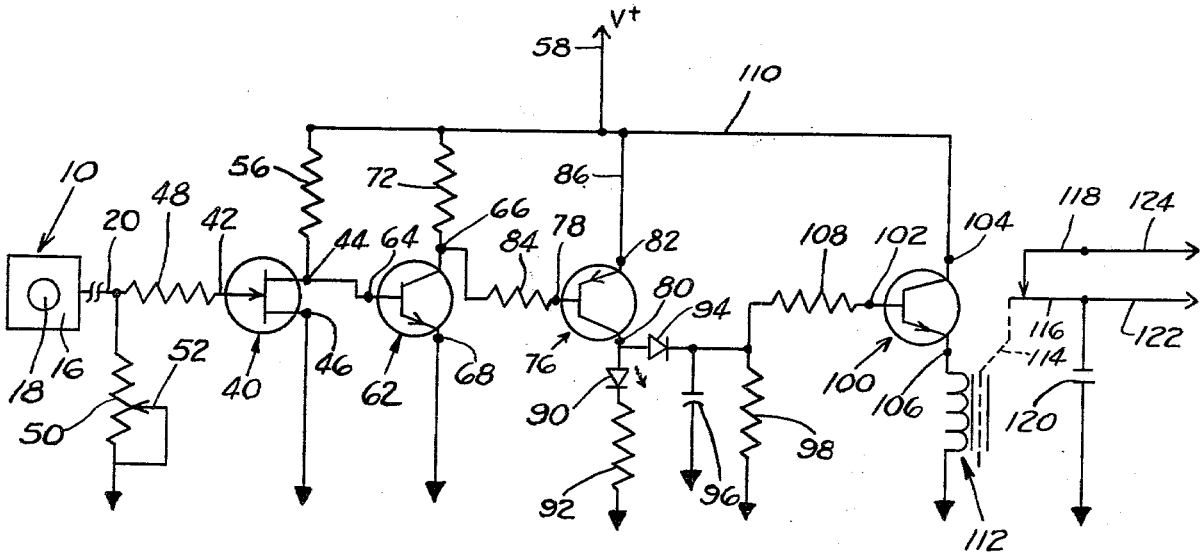
FIG. 2 is a schematic circuit diagram of a patient signalling system according to one embodiment of the present invention.

FIG. 2 shows in further detail the circuit contained in the housing 22 shown in FIG. 1. The circuit input stage includes a high input impedance semiconductor device in the form of a field effect transistor 40 having gate, source and drain terminals 42, 44 and 46, respectively. Gate terminal 42 is connected to one terminal of an input resistor 48, the other terminal of which is connected to the cable 20. The junction of resistor 48 and cable 20 also is connected to one terminal of a potentiometer 50, the other terminal of which is connected to the system or circuit ground. As will be discussed in further detail presently, the system electrical ground or reference is different from earth ground and is a floating ground. The wiper 52 of potentiometer 50 also is connected to the circuit ground. In accordance with a preferred mode of the present invention, the potentiometer 50 has a maximum value of 5 megohms. The source terminal 44 of transistor 40 is connected through a resistor 56 to a line 58 which, in turn, is connected to a positive d.c. bias voltage source designated V+ in FIG. 2. The source typically is a battery, and in accordance with a preferred mode of the present invention the magnitude of the bias voltage is about 9 volts. The drain terminal 46 of transistor 40 is connected to the circuit ground.

The circuit further comprises a direct-coupled a.c. amplifier including NPN transistor 62 having base, collector and emitter terminals 64, 66 and 68, respectively. Base terminal 64 is connected by a line 70 to the source terminal 44 of the preceding f.e.t. transistor stage. The emitter terminal of transistor 62 is connected to the circuit ground or reference. The collector terminal is connected through a resistor 72 to the bias voltage line 58.

The circuit further comprises a resistive coupled a.c. amplifier including a PNP transistor 76 having base, collector and emitter terminals 78, 80 and 82, respectively. Base terminal 78 is connected to one terminal of a coupling resistor 84, the other terminal of which is connected by a line 86 to the bias voltage line 58. The collector terminal 80 of transistor 76 is connected to the anode of a light emitting diode 90, the cathode of which is connected through a resistor 92 to the circuit ground. The collector terminal 80 also is connected to the anode of an ordinary diode 94, the cathode of which is connected to the junction of a capacitor 96 and resistor 98 comprising a parallel RC network. The other terminals of the capacitor 96 and the resistor 98 are connected to the circuit ground.

The circuit finally comprises a d.c. switch including an NPN transistor 100 having base, collector and emitter terminals 102, 104, 106, respectively. Base terminal 102 is connected to one terminal of a coupling resistor 108, the other terminal of which is connected to the junction of the cathode of diode 94 and the terminals of the capacitor and resistor 96 and 98. The collector terminal 104 of transistor 100 is connected by a line 110 to the bias voltage line 58. The emitter terminal 106 of transistor 100 is connected to one terminal of the control winding or coil of a relay generally designated 112. The other terminal of the winding is connected to the circuit ground. The plunger or operator element of the relay is designated by the broken line 114 and is operatively connected to a first movable switch contact 116 which is operatively associated with a second switch contact 118. Switch contacts 116, 118 in turn are connected in the electrical circuit of the appliance which is being controlled. A capacitor 120 is connected between the switch contact 116 and the circuit ground. Lines 122 and 124 in FIG. 2 indicate that the switch contacts 116 and 118, respectively, are connected electrically in the circuit of the appliance being controlled.

By way of example, in an illustrative circuit, potentiometer 50 has a magnitude of 5 megohms, resistor 48 has a magnitude of 2 megohms, transistor 40 is type 2N5457, resistor 56 has a magnitude of 47 kilohms, transistor 62 is type 2N3416, each of resistors 72 and 84 has a magnitude of 1 kilohm, transistor 76 is type 2N1412, resistor 92 has a magnitude of 180 ohms, capacitor 96 has a magnitude of 100 microfarads, resistor 98 has a magnitude of 1 kilohm, transistor 100 is type 2N3416, resistor 108 has a magnitude of 100 ohms and relay 112 is a Potter and Brumfield JRM 1000 reed relay.

In operation, the disc 18 of transducer 10 is isolated from earth ground, and when the patient touches disc 18 with his finger or the like the capacitance of the transducer is changed. This capacitance change is detected by the field effect transistor 40 resulting in the transistor 40 turning on causing current to flow through resistor 48. In particular, the whole circuit of FIG. 2 floats on an a.c. ripple voltage by virtue of the connection of capacitor 120 to the circuit of the appliance such as an intercom which is characterized by a.c. operation. As a result, the patient touching element 18 of transducer 10 results in the injection of a sine wave signal through resistor 48 into gate terminal 42 of transistor 40 which, in turn, causes a square wave to appear at the output terminal 44 of the transistor. The square wave signal is directly coupled to transistor 62 which functions as a direct coupled a.c. amplifier. The amplified output signal appearing on collector terminal 66 passes through resistor 84 to the input or base terminal of transistor 76 which functions as a resistive coupled a.c. amplifier. The amplified output signal appearing on collector terminal 80 energizes light-emitting diode 90 to give a visual indication that the system is operational. In this connection, diode 90 would be associated with indicator 28 on the housing 22 in the arrangement of FIG. 1. The amplified output signal on collector terminal 80 also is rectified by diode 94 and filtered by capacitor 96. The d.c. level which appears at the junction of capacitor 96 and the cathode of diode 94 is applied through resistor 108 to the base terminal of transistor 100 turning it on. Conduction of transistor 100 operates relay 112 moving plunger 114 to open the switch contacts 116,118 which are shown normally closed in the illustrative arrangement of FIG. 2. In the circuit shown for connection to an f.m. intercom system, opening of switch contacts 116, 118 causes the intercom signal to be activated as long as the patient touches element 18 of transducer 10. Once the patient removes his hand from element 18, the length of time transistor 100 continues to conduct to operate relay 112 to hold open the contacts 116, 118 is determined by the time constant of the network comprising capacitor 96 and resistor 98. The sensitivity of the circuit is determined by the combination of resistor 48 and potentiometer 50 and is adjusted by potentiometer 50. Capacitor 120 passes a 60 hertz ripple wave from the intercom system to the circuit, and since the circuit has its own ground or reference which is not earth ground, the circuit operation is modulated at 60 hertz. While the circuit of FIG. 2 activates a relay of the appliance, the output of transistor 100 can be connected to other components for interfacing to the particular appliance with which the circuit is employed.

The circuit of FIG. 2 is particularly desirable as a patient signalling system for use in the home. In the foregoing illustration the circuit was connected to a pair of f.m. wireless intercom units with the intercom locked in the "talk" position so that the patient is monitored at all times. The two intercom units can be utilized throughout the home by plugging them into any outlets on the same electrical line. The slightest touch by the patient on the transducer operates the system to send out an audible signal to a unit in another room alerting the nurse or other person caring for the patient that help is needed. Also, the indicator provided by the light-emitting diode enables the patient to see that the unit is operating. The high degree of sensitivity of the circuit, which is adjustable, allows patients with very limited movement to operate the unit. The circuit of FIG. 2 also can be employed to enable the patient to operate automatic telephone dialing and answering apparatus, to operate a word sequencer, to turn on a television or radio receiver, to operate the transmit key on a microphone for a citizens' band or two way radio, and to open a door by actuating a remote door lock. All of these additional applications, more of which are possible, are provided in response to the patient simply touching the sensitive area of the transducer.

Figure 3:
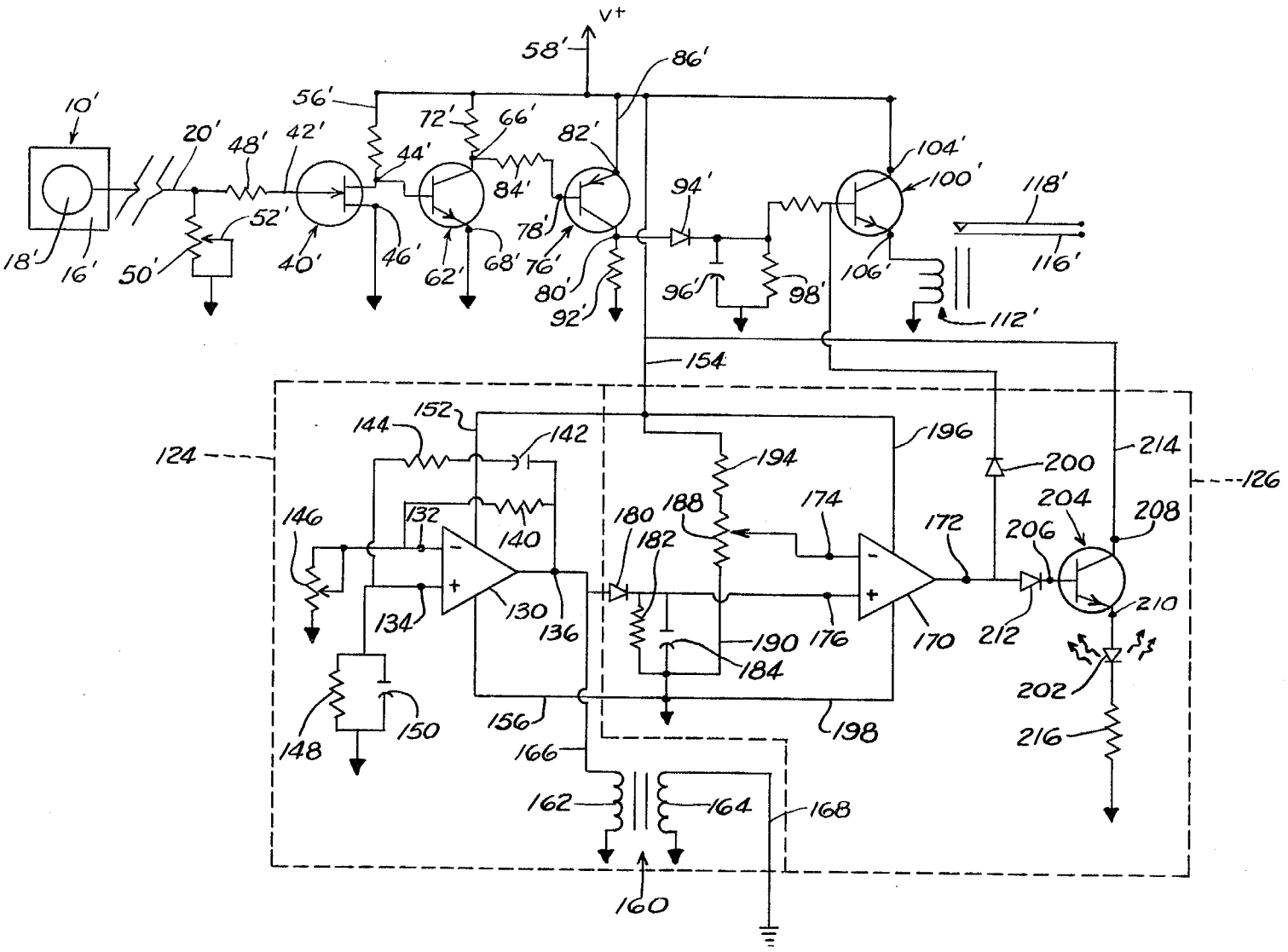
FIG. 3 is a schematic circuit diagram of a patient signalling system according to another embodiment of the present invention.

FIG. 3 illustrates a patient signalling system according to another embodiment of the present invention which includes a touch-responsive signalling circuit similar to that of FIG. 2, a modulator circuit designated 124 in FIG. 3, and a circuit 126 for indicating when the battery voltage level is below a predetermined value. In the touch-responsive signalling portion, components similar to those of the circuit of FIG. 2 are identified by like reference numerals provided with a prime designation. The modulator 124 enhances electrical isolation of the patient and includes an oscillator circuit comprising an amplifier 130 having a pair of inputs 132,134 and an output 136. A resistor 140 is connected between output 136 and input 132. The series combination of a capacitor 142 and a resistor 144 is connected between amplifier output 136 and the other input 134. Amplifier input 132 is connected through a potentiometer 146 to the circuit ground or reference terminal which is different from earth ground. Amplifier input 134 also is connected through a parallel RC circuit comprising resistor 148 and a capacitor 150 to the circuit ground or reference terminal. One bias voltage terminal of amplifier 130 is connected by lines 152, 154 on the line 58' from the source of positive bias voltage V+. The other bias voltage terminal of amplifier 130 is connected by a line 156 to the circuit ground or reference.

In order to provide electrical isolation of the patient from the floating ground or circuit ground, there is provided an isolation transformer designated 160 having first and second windings 162 and 164, respectively. The output amplifier 130 is connected by a line 166 to one terminal of the first winding 162, the other terminal of which is connected to the circuit ground. One terminal of the second winding 164 is connected by a line 168 to earth ground and the other terminal of winding 164 is connected to the circuit ground.

The circuit 126 for detecting low battery voltage includes an amplifier 170 having an output 172 and a pair of inputs 174 and 176. Amplifier input terminal 176 is connected to the cathode of diode 180, the anode of which is connected to the output terminal 136 of the oscillator amplifier 130. The cathode of diode 180 also is connected to a parallel RC network comprising a bleeder resistor 182 and a capacitor 184 to the circuit ground or reference. The other amplifier input terminal 174 is connected to the wiper arm of a potentiometer 188. One terminal of potentiometer 188, in turn, is connected by a line 190 to the circuit ground or reference terminal. The other terminal of potentiometer 188 is connected through a resistor 194 to line 154 and ultimately to line 58' leading from the source of positive bias voltage, i.e. the system battery. One bias voltage terminal of amplifier 170 is connected by a line 196 to line 154 and hence to the line 58' leading from the battery or d.c. voltage source. The other bias voltage terminal of amplifier 170 is connected by a line 198 to the circuit ground or reference terminal. The amplifier output terminal 172 is connected to the anode of the diode 200, the cathode of which is connected to the base terminal 102' of the transistor switch 100'. The circuit also includes a visible indicator in the form of a light-emitting diode 202. Diode 202 is activated by an arrangement including a semiconductor switch in the form of an NPN transistor 204 having base, collector and emitter terminals 206, 208 and 210, respectively. The output terminal 172 of amplifier 170 is connected to the anode of a diode 212, the catode of which is connected to transistor base terminal 206. The transistor collector terminal 208 is connected by a line 214 to the line 154 and ultimately to line 58' leading from the battery or d.c. voltage source. The emitter terminal 210 of transistor 204 is connected to the anode of light emitting diode 202, the cathode of which is connected through a resistor 216 to the circuit ground or reference terminal.

By way of example, in an illustrative circuit, in the touch-responsive signalling portion, the components bearing the same reference numerals, with prime descriptions, as the components in the circuit of FIG. 2 are of the same exemplary magnitude and type as given in the illustration hereinabove. As to the modulator portion, by way of example, amplifier 130 is an integrated circuit type LM358 amplifier, resistor 140 has a magnitude of 750 ohms, each of capacitors 142 and 150 has a magnitude of 0.001 microfarads, each of resistors 144 and 148 has a magnitude of 220 kilohms, potentiometer 146 has a magnitude of 500 ohms, and transformer 160 is of the type Calectro D1-711 or the equivalent wherein the turns ratio of winding 162 to 164 is 1:5, the resistances of windings 162 and 164 are 2 kilohms and 10 kilhoms, respectively and the voltage measured across winding 164 is 7 volts peak-to-peak at 463 hertz. As to the battery voltage level indicating portion, amplifier 170 is an integrated circuit type LM358 amplifier, resistor 182 has a magnitude of 100 kilohms, capacitor 184 has a magnitude of 22 microfarads, resistor 188 has a magnitude of 2 megohms, resistor 194 has a magnitude of 13 kilohms, transistor 204 is type 2N3904 and resistor 216 has a magnitude of 50 ohms.

In operation, the touch responsive signalling portion of the circuit of FIG. 3 operates in a manner identical to that of the circuit of FIG. 2 as described hereinabove. The only exception is the relationship between relay 112' and switch contacts 116', 118' which in the circuit of FIG. 3 are normally open and are closed by operation of relay 112' to cause operation of the associated appliance, i.e. activate the intercom to a call condition. The modulator portion includes an oscillator consisting of amplifier 130, resistors 140, 144, 146 and 148 and capacitors 142 and 150. The oscillator output is stepped up by the transformer 160 to a signal amplitude of about 7 volts peak to peak. Transformer 160 also serves to isolate the oscillator signal, the output winding 164 being connected between the circuit or floating ground and earth ground. The modulator portion modulates the signal associated with the circuit reference or ground with respect to the earth ground. The arrangement may be viewed as a closed loop system proceeding from one ground or reference connected to one terminal of transformer output winding 164 through the circuit to the touch sensitive element of the transducer and through the circuit again to the other ground or reference to the other terminal of transformer output winding 164.

The battery voltage level indicating portion obtains a reference signal from the output of the oscillator. In particular, the oscillator output signal on amplifier output terminal 136 is rectified by diode 180, filtered by capacitor 184 and applied to input terminal 176 of amplifier 170. The battery voltage is applied through line 154, resistor 194 and potentiometer 188 to the other input terminal 174 of amplifier 170. When the battery voltage level falls to a predetermined level, as determined by the setting of potentiometer, the voltage on amplifier terminal 176 exceeds the voltage on terminal 174 by an amount sufficient to cause amplifier 170 to turn on the transistor 204. This in turn energizes light emitting diode 202 providing visual indication of the decreased battery voltage. This also turns on transistor 100' causing operation of the associated appliance to signal the existence of decreased battery voltage. As a result, the nurse or other attendant caring for the patient will respond to the signal and upon returning to the patient will see the visual indication provided by the energized light emitting diode and thus be alerted that battery replacement is needed.

Figure 4:
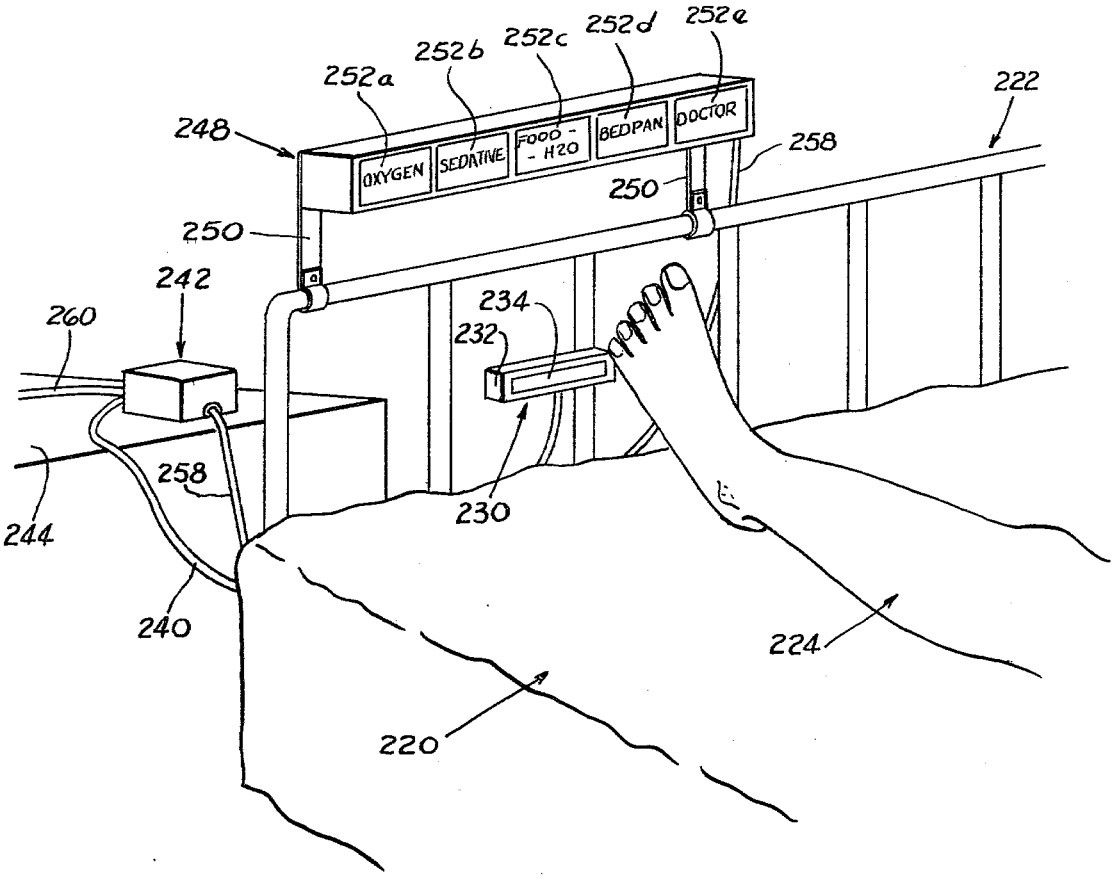
FIG. 4 is a fragmentary perspective view of a patient signalling system according to another embodiment of the present invention as it would appear in use.

The system of FIG. 3, in providing electrical isolation of the patient relative to the circuit or floating ground, is particularly desirable for use with patients in intensive care and cardiac units of hospitals as well as in other hospital areas wherein protection from electrical shock hazard is important. FIG. 4 illustrates another application of the patient signalling system of the present invention. In the arrangement illustrated in FIG. 4, the patient can cause the transmission of a message indicating the nature of the assistance which he needs rather than merely a general signal or alarm indicating that some type of assistance, yet to be identified, is needed. FIG. 4 shows the foot end portion of a bed 220 which is provided with a rail assembly generally designated 222 at the foot of the bed. The bed supports a patient whose leg is designated 224. The patient signallng system includes a modified form of touch-sensitive transducer generally designated 230 which is elongated and rectangular solid in form including a body 232 of dielectric material and an elongated rectangular plate 234 on the one face thereof. As in the preceding embodiments, the body 232 can be of an acrylic plastic material and plate 234 preferably is of stainless steel. The transducer 234 is mounted by suitable means (not shown) to the bed rail 222 in a manner such that the plate 234 faces the leg 224 of the patient and that the plate 234 is at a height so that it may be touched by the end of the patient's leg, preferably one of his toes. Alternatively, the transducer 230 could be located elsewhere, as in the preceding embodiments or perhaps mounted to a bed sideboard so as to be reachable by the arm and hand of the patient. Transducer 230 is connected by an electrical cable designated 240 to a circuit contained in a housing 242 which rests on or is otherwise supported by a suitable supporting surface such as a table 224. A conductor of the cable 240 is connected to plate 234 in a manner similar to that of the preceding embodiments. A circuit within housing 232 is similar to that of the preceding embodiments.

In the system shown, the nature of operation is such that a different message is signalled or transmitted to a remote location, such as a nurses' station in a hospital, depending upon the number of times the patient touches the transducer 230. For example, as illustrated in FIG. 4, if the patient touches the transducer one time this is a signal that he requires oxygen. If the patient touches the transducer two times in succession this signals that he needs a sedative. Three touches signal need for food or water, four touches need for a bedpan and five touches need for a physican. Other coding schemes can of course be employed, with the requirement that they be relatively simple for the patient to comprehend and operate. To assist the patient in this regard, the arrangement according to the present invention includes a visible display means generally designated 248 which is placed at a location easily seen by the patient, for example fixed to the bed rail 222 by a pair of brackets 250. In the system shown, the display 248 is in the form of an elongated rectangular solid housing having a plurality of electrically-operated display elements therein facing the patient so as to be visible by him. For example, display element **252*a*, energized when the patient touches the transducer plate 234 once, indicates to him that he has signalled a need for oxygen. Display element 252*b*, energized when the patient touches the transducer plate twice, indicates to him that he has signalled need for a sedative. Similarly, the display elements 252*c*, 252*d*, and 252*e*, energized when the patient touches the transducer plate three, four and five times, respectively, indicates to him that he has signalled need for food or water, bedpan or physican. The electrically operated display means 248 is connected by an electrical cable 258 to the circuit contained within housing 242. Suitable circuitry, for example including a digital counter, is provided for converting the number of touch-initiated signals provided by the circuit within the housing 242 to the proper display element operation. The signals also are transmitted by a cable 260, a portion of which is shown in FIG. 4**, to the remote location such as the nurses' station, where the message is received and decoded in a similar manner to indicate to persons at that location the particular request signalled by the patient.

The patient signalling system of the present invention is touch responsive and advantageously is activated in a manner requiring the slightest expenditure of effort on the part of the patient. The circuit including the combination of high input impedance semiconductor device, direct-coupled a.c. amplifier, resistive coupled a.c. amplifier and d.c. semiconductor switch is electrically compatible with, i.e. provides an output of sufficient magnitude to initiate operation of, electrically operated relays or similar interface devices at the inputs of intercoms or other appliances which the system is to signal or cause operation thereof. In addition, the circuit or floating ground and provision for isolating the transducer and hence the patient from that ground by means of the modulator-transformer combination desirably eliminates the possibility of any shock hazard to the patient.

It is therefore apparent that the present invention accomplishes its intended objects. While several embodiments of the present invention have been described in detail, this is for the purpose of illustration, not limitation.

We claim:

1. A patient signalling system comprising:

(a) a touch sensitive capacitive transducer comprising an exposed conductive plate carried by a body of dielectric material, said transducer adapted to be conveniently and comfortably placed with a patient afflicted with an illness or paralysis rendering him incapable of providing any significant manual force or dexterity;

(b) a flexible electrical cable of significant length connected at one end to said plate; and (c) a circuit having an input and an output and located physically remote from the patient, said circuit input connected to the other end of said cable, said circuit converting a change in capacitance of said transducer when touched by the patient into an electrical signal for causing operation of an appliance connected to said circuit output, said circuit comprising a source of supply voltage, a high gain amplification stage operatively connected to said supply and having an input connected to said transducer for converting a minute signal produced by said transducer when touched by said patient into an output signal which switches at the voltage level of said supply, a wave shaping stage having an input connected to the output of said high gain amplification stage for converting impulse signals into square wave output signals, and a d.c. switch connected in controlled relation to the output of said wave shaping stage for causing completion of an electrical power circuit for the appliance.

2. A system according to claim 1, wherein said transducer comprises a body of plastic material having a planar surface and a metal plate fixed to said surface.

3. Apparatus according to claim 1, wherein said circuit comprises:

(a) an input semiconductor device having a high input impedance and an output;

(b) a direct coupled a.c. amplifier having an input coupled to the output of said semiconductor device and an output;

(c) a resistive coupled a.c. amplifier having an input coupled to the output of said direct coupled amplifier and an output; and (d) a d.c. semiconductor switch coupled to the output of said resistive coupled amplifier.

4. Apparatus according to claim 3, further including a potentiometer operatively connected to said input semiconductor device for controlling the sensitivity of said system.

5. Apparatus according to claim 3, further including a resistance—capacitance circuit operatively connected to said d.c. semiconductor switch for controlling the time during which said semiconductor switch is on.

6. Apparatus according to claim 3, further including a light-emitting diode operatively connected to said resistive coupled amplifier for indicating operation of said system.

7. Apparatus according to claim 3, further including a relay having a winding connected in controlled relation to said d.c. semiconductor switch and said relay connected in controlling relation to an electrical circuit of an appliance, the operation of which is caused by said system circuit in response to touching of said transducer plate by the patient.

8. Apparatus according to claim 1, wherein the appliance is a.c. operated and further including means for coupling a.c. voltage from the appliance into said circuit.

9. Apparatus according to claim 3, wherein the appliance is a.c. operated and further including means for coupling a.c. voltage from the appliance into said circuit, said coupling means comprising a capacitor connected in the output circuit of said d.c. semiconductor switch.

10. Apparatus according to claim 1, wherein said circuit has an electrical ground in floating relation to earth ground.

11. Apparatus according to claim 10, further including means for isolating said transducer means electrically from said floating ground.

12. A patient signalling system comprising:

(a) a touch sensitive capacitive transducer comprising an exposed conductive plate carried by a body of dielectric material, said transducer adapted to be conveniently and comfortably placed with a patient afflicted with an illness or paralysis rendering him incapable of providing any significant manual force or dexterity;

(b) a flexible electrical cable of significant length connected at one end to said plate;

(c) a circuit having an input and an output and located physically remote from the patient, said circuit input connected to the other end of said cable, said circuit converting a change in capacitance of said transducer when touched by the patient into an electrical signal for causing operation of an appliance connected to said circuit output, said circuit having an electrical ground in floating relation to earth ground; and (d) means for isolating said transducer means electrically from said floating ground, said isolating means comprising modulator circuit means operatively connected to said circuit means and isolation transformer means operatively connected to said modulator circuit means and to said circuit electrical ground and to earth ground.

13. Apparatus according to claim 1, further including:

(a) a battery for supplying direct voltage to said circuit; and (b) means for monitoring the level of direct voltage provided by said battery and for indicating when said battery voltage level falls below a predetermined value.

14. Apparatus according to claim 13, wherein said monitoring means comprises:

(a) means for providing a voltage reference; and (b) comparison means operatively connected to said battery and to said voltage reference means for providing an output signal in response to a predetermined relation between the levels of said battery voltage and said reference voltage.

15. Apparatus according to claim 14, further including means operatively connected to said comparison means for providing a visual indication in response to an output signal from said comparison means.

16. Apparatus according to claim 14, further including means for connecting said comparison means to said circuit means in a manner such that said circuit means causes operation of the appliance in response to an output signal from said comparison means to signal that the battery voltage has fallen below a predetermined level.

17. Apparatus according to claim 1 further including a potentiometer operatively connected to said high gain amplification stage for controlling the sensitivity of said system.

* * * * *